52-17
10/22/85 OR 4,548,629 SR

United States Patent [19]
Chiu

[11] Patent Number: 4,548,629
[45] Date of Patent: Oct. 22, 1985

[54] PROCESS FOR THE LIQUEFACTION OF NATURAL GAS

[75] Inventor: Chen-hwa Chiu, Houston, Tex.

[73] Assignee: Exxon Production Research Co., Houston, Tex.

[21] Appl. No.: 540,957

[22] Filed: Oct. 11, 1983

[51] Int. Cl.[4] ..... F25J 3/02
[52] U.S. Cl. ..... 62/17; 62/24; 62/40; 62/335; 62/510
[58] Field of Search ..... 62/9, 11, 23, 24, 27, 62/28, 36, 40, 335, 510, 17, 18

[56] References Cited

U.S. PATENT DOCUMENTS 3,763,658 10/1973 Gaumer et al. ..... 62/40

*Primary Examiner*—Frank Sever
*Attorney, Agent, or Firm*—Kenneth C. Johnson

[57] ABSTRACT

The present invention is a process for the liquefaction of high pressure natural gas. The natural gas is expanded through a turboexpander to reduce its pressure and thereby cool it. The natural gas is then passed through a demethanizer to remove the heavier components therefrom. The natural gas is then precooled, before substantial warming occurs, by heat exchange with a $C_2$ hydrocarbon refrigerant, either ethane or ethylene, contained in a single refrigerant system. The precooled natural gas is liquefied by heat exchange with a mixed refrigerant contained in a mixed refrigerant system. The mixed refrigerant consists essentially of nitrogen, methane and a $C_2$ hydrocarbon, either ethane or ethylene. The mixed refrigerant contained in the mixed refrigerant system is cooled by heat exchange with the $C_2$ hydrocarbon refrigerant contained in the single refrigerant system.

11 Claims, 2 Drawing Figures

PROCESS FOR THE LIQUEFACTION OF NATURAL GAS

FIELD OF THE INVENTION

The present invention relates to the liquefaction of natural gas. More particularly, the present invention relates to a $C_2$ precooled mixed refrigerant process for liquefying natural gas.

BACKGROUND OF THE INVENTION

Common processes for liquefying natural gas are cascade processes, mixed refrigerant processes and precooled mixed refrigerant processes. In cascade processes, the natural gas is cooled and liquefied by sequential heat exchange with a series of different refrigerants contained in separate refrigeration systems. The refrigerants are selected and arranged so that their composite cooling curve closely matches the cooling curve of the natural gas. Each individual refrigerant provides the cooling duty over its optimum range. By using a sequence of refrigerants, the feed stream of natural gas is cooled from around ambient temperature to about −265° F. (−165° C.), a typical temperature for liquefied natural gas.

Although cascade processes are thermodynamically efficient, they have the drawback of requiring a great deal of expensive equipment. Since each refrigerant is typically handled by a separate refrigeration system, many compressors and other components must be used. To overcome this problem, mixed refrigerant processes have been developed which approach the thermodynamic efficiency of cascade processes, but which require less equipment.

In mixed refrigerant processes, a mixed refrigerant composition is selected which has a cooling curve that closely matches the cooling curve of the natural gas. However, rather than being handled in separate refrigeration systems, the individual refrigerants are mixed together and are handled by one refrigeration system. The mixed refrigerant typically consists of several refrigerant components having different boiling points. The mixed refrigerant components having the higher boiling points are used to provide the initial cooling, and those having the lower boiling points are used to liquefy the natural gas. With the mixed refrigerant vaporizing at different temperatures and pressures, the components of the mixed refrigerant are able to provide staged coolings over their respective optimum temperature ranges.

LNG plants which employ mixed refrigerant processes generally cost less to build and operate than those using cascade processes. As mentioned, they cost less to build because only one refrigeration system is required. They cost less to operate due to the utilization of larger compressors which are mechanically more efficient than the multiple smaller compressors required for cascade processes.

A refinement on mixed refrigerant processes is the use of an additional refrigeration system to precool the natural gas prior to heat exchange with the mixed refrigerant. This additional refrigeration system can also be used to cool the mixed refrigerant. The additional refrigeration system can employ a single refrigerant or a multicomponent refrigerant. Such systems are known as precooled mixed refrigerant processes or as combined cascade and mixed refrigerant processes. U.S. Pat. No. 3,763,658 to Gaumer et al discloses a precooled mixed refrigerant process which utilizes a single-component precooling refrigerant. The single-component refrigerant can be a $C_2$, $C_3$ or $C_4$ hydrocarbon. The mixed refrigerant is a four-component refrigerant consisting of nitrogen, methane, ethane and propane. An example of a precooled mixed refrigerant process which utilizes a multicomponent precooling refrigerant is described in U.S. Pat. No. 4,229,195 to Förg. That process uses a mixture of $C_2$ and $C_3$ hydrocarbons as the precooling refrigerant. The mixed refrigerant used to liquefy the natural gas consists of nitrogen, methane, ethylene and propane.

By using an additional refrigeration system to precool the natural gas and the mixed refrigerant, precooled mixed refrigerant processes can more closely match the cooling curve of the natural gas, thereby achieving a better thermodynamic efficiency.

Despite the efficiencies of current cascade, mixed refrigerant and precooled mixed refrigerant processes, none are thermodynamically efficient for the liquefaction of certain natural gas streams available at high pressure. The present invention is aimed at providing such a process.

SUMMARY OF THE INVENTION

The present invention involves a process for the liquefaction of natural gas available at a high pressure using a precooled mixed refrigerant process. The natural gas is supplied at a pressure above about 600 psia (4137 kPa) and is expanded to reduce it temperature to below about −40° F. (−40° C.). The natural gas is then passed through a demethanizer to remove most of the heavier components therefrom. The natural gas is then precooled, before substantial warming occurs, by heat exchange with a $C_2$ hydrocarbon refrigerant, either ethane or ethylene, contained in a single refrigerant system. The precooled natural gas is then liquefied by heat exchange with a mixed refrigerant contained in a mixed refrigerant system. The mixed refrigerant consists essentially of nitrogen, methane and a $C_2$ hydrocarbon, either ethane or ethylene. The mixed refrigerant is cooled by heat exchange with the $C_2$ hydrocarbon refrigerant contained in the single refrigerant system.

DESCRIPTION OF THE PREFERRED EMBODIMENT

Figure 1:
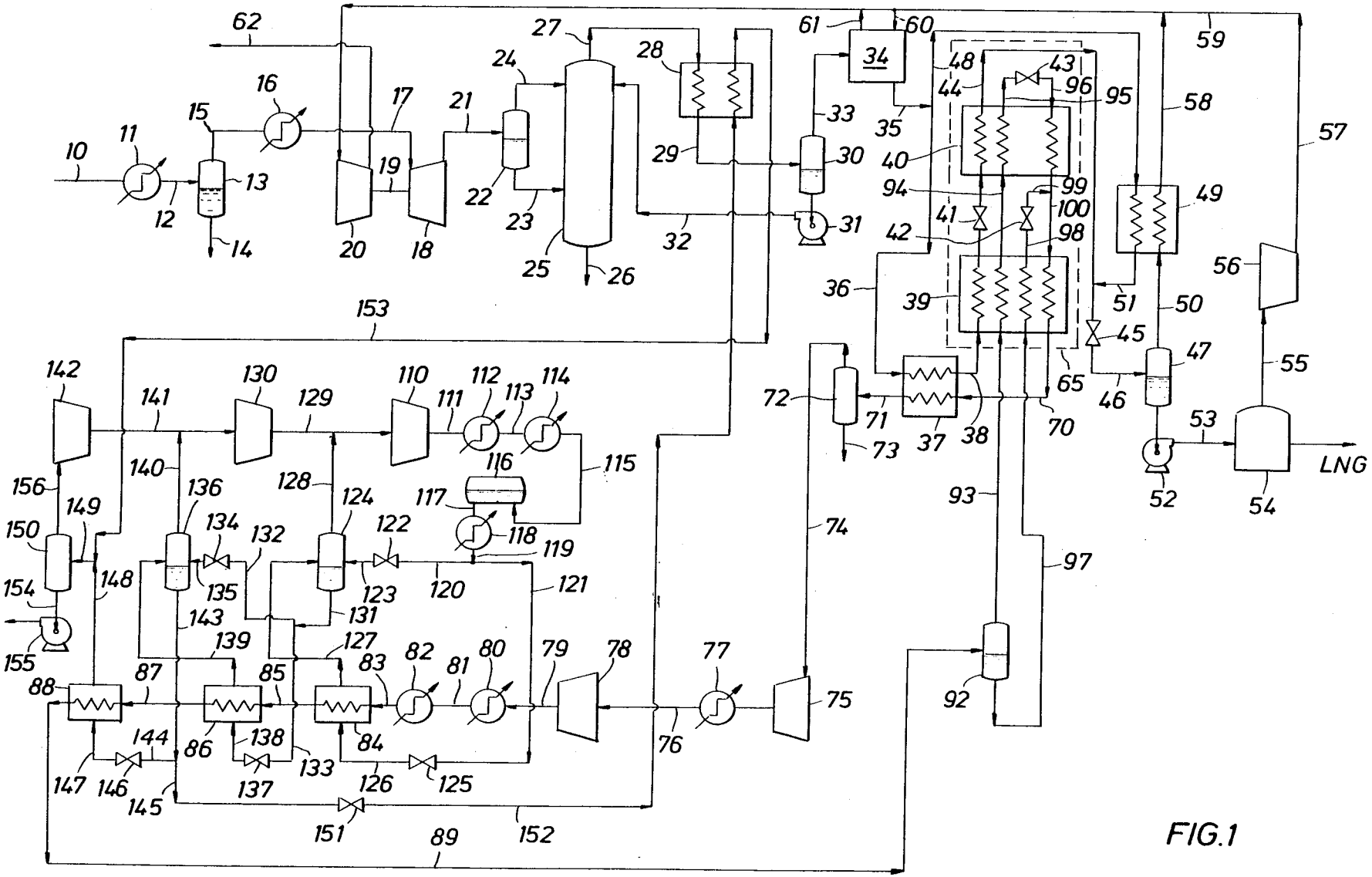
FIG. 1 is a schematic flow diagram of a liquefaction process illustrating a first preferred embodiment of the present invention.

Referring to FIG. 1, a first preferred embodiment for practicing the process of the present invention is illustrated. It shows a schematic representation of an LNG plant which has two primary refrigeration systems. The first system is a single refrigerant system which contains a $C_2$ hydrocarbon refrigerant, either ethane or ethylene. The second system is a mixed refrigerant system which contains a mixed refrigerant consisting essentially of nitrogen, methane and a $C_2$ hydrocarbon, either ethane or ethylene. The single refrigerant system precools the natural gas and also cools the mixed refrigerant. The mixed refrigerant system provides the final cooling needed to liquefy the natural gas.

The feed stream of natural gas flows to the LNG plant through line 10. The natural gas is commonly made up of many components, including $C_1$ through $C_6$ hydrocarbons, water, carbon dioxide and hydrogen sulfide. The natural gas is delivered at a pressure above about 600 psia (4137 kPa), and preferably between about 1000 and 2000 psia (6895 to 13,790 kPa), and has a temperature between about 75° and 150° F. (24° to 66° C.). The natural gas may first be passed through water cooler 11, which cools the natural gas to between about 70° and 100° F. (21° to 38° C.). If necessary, the natural gas is then dehydrated. The natural gas travels through line 12 and enters dehydrator 13, which extracts water and some heavy liquids from the natural gas. The water and heavy liquids are removed from dehydrator 13 through line 14. The dehydrator can be one of several types well known to those skilled in the art, such as a glycol dehydrator. Additional dehydration may be carried out later in the process, as will be described below.

The dehydrated natural gas exits dehydrator 13 through line 15 and enters heat exchanger 16. Heat exchanger 16 uses a suitable refrigerant to reduce the temperature of the natural gas to between about −30° and −40° F. (−34° to −40° C.). Suitable refrigerants include propane, propylene, ammonia, carbon dioxide and freon. Alternatively (not shown), the cold liquids from the bottom of demethanizer 25 can be used as the refrigerant in heat exchanger 16. Line 17 carries the high pressure natural gas from heat exchanger 16 to turboexpander 18. The turboexpander may be connected by shaft 19 to compressor 20, which is used to compress flash vapor and boil off gas for fuel, as will be described below. The mechanical energy obtained by expanding the natural gas through the turboexpander is thus utilized to run compressor 20. The natural gas exiting the turboexpander is typically at a pressure between about 450 and 650 psia (3103 to 4482 kPa) and has a temperature between about −60° and −125° F. (−51° to −87° C.).

The expansion and consequent temperature reduction of the natural gas by the turboexpander condenses a portion of the heavier components of the natural gas. The resulting mixture of liquid and gas passes from the turboexpander through line 21 and into separator 22. The liquid and gas fractions from separator 22 are then passed into demethanizer 25 at different optimum feed locations to remove the heavier components from the natural gas. The liquid fraction from the bottom of separator 22 passes through line 23 and into the demethanizer at an intermediate level. The gas fraction from separator 22 is carried by line 24 to the top of the demethanizer.

Demethanizers suitable for use in the process of the present invention are well known to those skilled in the art. The demethanizer removes most of the carbon dioxide and the $C_3$, $C_4$, $C_5$, and $C_6$ hydrocarbons from the natural gas. Some of the $C_2$ hydrocarbon components are also removed. These products leave the demethanizer through line 26 and are sent to LPG processing steps (not shown).

Typically, the natural gas overhead from the demethanizer contains predominately methane, with a relatively small amount of $C_2$ hydrocarbons, and is at a temperature between about −60° and −120° F. (−51° to −84° C.). In conventional processes, this natural gas becomes warmed either by the environment during transport, or by other processing steps, prior to being subjected to liquefaction cooling steps. In contrast, the method of the present invention subjects the already cold natural gas to liquefaction cooling steps before substantial warming occurs. Thus, the low temperature of the natural gas which results from the expansion in turboexpander 18 is conserved, thereby yielding a better thermodynamic efficiency.

The natural gas overhead from the demethanizer passes through line 27 and into reflux condenser 28, where it is precooled to between about −120° and −125° F. (−84° to −87° C.). The precooling is provided by the $C_2$ hydrocarbon of the single refrigerant system, which will be described in detail below. This precooling results in condensation of part of the natural gas. The natural gas then passes through line 29 and enters reflux drum 30. The liquid fraction from reflux drum 30 is sent by pump 31 through line 32 back to the top of the demethanizer as a reflux. The gaseous fraction from reflux drum 30 passes through line 33 to dehydration system 34 for additional water and carbon dioxide removal if necessary. Dehydration systems suitable for use in the process of the present invention are well known to those skilled in the art.

The natural gas leaves the dehydration system through line 35 and is separated into two streams, a main stream and a side stream. The main stream goes via line 36 to heat exchanger 37 where it is cooled to between about −120° and −125° F. (−84° to −87° C.) by the mixed refrigerant returning from cryogenic heat exchanger 39. The mixed refrigerant system will be described in detail below. The natural gas then enters a cryogenic heat exchange system via line 38 to be liquefied. The cryogenic heat exchange system is designated in FIG. 1 by box 65 and comprises first cryogenic heat exchanger 39, second cryogenic heat exchanger 40 and associated Joule-Thomson (J-T) expansion valves 41, 42 and 43. Cryogenic heat exchangers 39 and 40 are preferably either coil-wound heat exchangers or plate-fin heat exchangers.

The natural gas is cooled by the mixed refrigerant to between about −190° and −215° F. (−123° to −137° C.) in first cryogenic heat exchanger 39 by the mixed refrigerant. The natural gas then exits the first cryogenic heat exchanger and undergoes an isoenthalphic flash across J-T valve 41. This flash reduces the pressure of the natural gas to between about 150 and 250 psia (1034 to 1724 kPa). The natural gas then enters second cryogenic heat exchanger 40 where it is liquefied and either slightly or deeply subcooled by heat exchange with the mixed refrigerant. The LNG exiting the second cryogenic heat exchanger is at a temperature between about −240° and −250° F. (−151° to −157° C.) and a pressure between about 145 and 245 psia (1000 to 1689 kPa).

In order to facilitate storage in large LNG tanks, the pressure of the LNG must be reduced. The LNG passes through line 44 to J-T valve 45 where the pressure is dropped to between about 18 and 50 psia (124 to 345 kPa). As a result of the pressure reduction, a portion of the LNG flashes into vapor. The LNG and flash vapor mixture passes through line 46 to flash drum 47 where the LNG portion settles to the bottom. The cold flash vapor is removed from the flash drum and part of its refrigeration potential is recovered in heat exchanger 49 to liquefy the side stream of natural gas which bypasses the cryogenic heat exchange system.

The side stream of natural gas enters line 48 from line 35, downstream from the dehydration system. Line 48 carries the side stream of natural gas to heat exchanger 49 where it is liquefied by heat exchange with the cold flash vapor from flash drum 47. The cold flash vapor passes from the flash drum to heat exchanger 49 via line 50. The side stream of LNG exits heat exchanger 49 at a temperature between about −240° and −250° F. (−151° to −157° C.) and a pressure between about 410 and 610 psia (2827 to 4206 kPa). It travels through line 51 and into line 44 upstream from J-T valve 45, where it is reunited with the main stream of LNG. After being let down in pressure across J-T valve 45 and separated from the resulting flash vapor in flash drum 47, the LNG is pumped by cryogenic pump 52 through line 53 and into LNG storage tank 54.

The boil-off gas from the LNG storage tank is used along with the flash vapor from heat exchanger 49 to provide the regenerating gas for dehydration system 34 and to provide fuel gas. The boil-off gas from the storage tank flows through line 55 to boil-off gas blower 56, which sends the boil-off gas through lines 57 and 59. The flash vapor from heat exchanger 49 is carried by line 58 and combines with the boil-off gas in line 59. The combined boil-off gas and flash vapor enters dehydration system 34 though line 60. If necessary, heating means can be used to increase the temperature of the gas to that required for regeneration of the dehydrators (not shown) in dehydration system 34. The combined boil-off gas and flash vapor then exits the dehydration system through line 61 and is recombined with the fuel gas in line 59. The fuel gas flows via line 59 to compressor 20 for compression. The compressed fuel gas exits compressor 20 through line 62 and is sent to a fuel gas system (not shown). As described above, compressor 20 is driven by turboexpander 18.

This concludes the description of the components of the first preferred embodiment which handle the natural gas. The description of the first preferred embodiment now turns to the two primary refrigeration systems, the mixed refrigerant system and the single refrigerant system. The mixed refrigerant system will be described first.

The mixed refrigerant system contains a mixed refrigerant which is used to liquefy the natural gas in cryogenic heat exchange system 65. The mixed refrigerant consists essentially of nitrogen, methane and a $C_2$ hydrocarbon, either ethane or ethylene. The choice between ethane and ethylene depends primarily on their respective price and availability at the LNG plant site. From the sole standpoint of thermodynamic efficiency, ethane is preferred. The temperatures and pressures given in the description below are for the case where ethane is used as the $C_2$ hydrocarbon in the mixed refrigerant.

Preferably, the mole fractions of the mixed refrigerant components will be about 2 to 12% nitrogen, 30 to 65% methane and 35 to 55% $C_2$ hydrocarbon. The use of a mixed refrigerant consisting essentially of nitrogen, methane and a $C_2$ hydrocarbon for the liquefaction of natural gas in the process of the present invention is thermodynamically more efficient than the utilization of mixed refrigerants comprising nitrogen, methane, ethane and propane as taught by the prior art. By introducing the cold overhead from demethanizer 25 into reflux condenser 28 and cryogenic heat exchanger system 65 before substantial warming takes place, the three-component mixed refrigerant composition of the present invention can be used instead of the prior art four-component mixed refrigerants. By using only three components in the mixed refrigerant, smaller cryogenic heat exchangers can be used in cryogenic heat exchange system 65, and simpler refrigerant recovery and supply systems (not shown) can be used, thereby resulting in significant savings on equipment expense. In conventional processes, warming of the natural gas results from processing steps or transport following demethanization, thus necessitating the use of four-component mixed refrigerants.

After providing the cooling duty to liquefy the natural gas stream in cryogenic heat exchange system 65, the mixed refrigerant vapor travels through line 70 to heat exchanger 37 to cool the main natural gas stream. The mixed refrigerant exits heat exchanger 37 through line 71 and enters suction scrubber 72. The function of suction scrubber 72 is to remove any entrained liquids from the mixed refrigerant so that the compressors of the mixed refrigerant system will not be damaged. Any such liquids are removed from suction scrubber 72 through line 73. The mixed refrigerant vapor leaves suction scrubber 72 through line 74 and enters compressor 75. Compressor 75 raises the pressure of the mixed refrigerant vapor to between about 116 and 190 psia (800 to 1310 kPa). The vapor exits compressor 75 through line 76 and goes through a second stage of compression in compressor 78, which raises the pressure to between about 390 and 600 psia (2689 to 4137 kPa). If desired, the mixed refrigerant vapor can be cooled by interstage water cooler 77 prior to entering compressor 78.

Since the mixed refrigerant contains three component refrigerants which have different phase behaviors, the component vapors condense to liquids at different points as the mixed refrigerant is cooled in the steps to follow. For this reason, the mixed refrigerant will be referred to as a mixed refrigerant fluid.

The mixed refrigerant fluid exits compressor 78 through line 79 and goes to water aftercooler 80 where the mixed refrigerant fluid is cooled to between about 50° and 110° F. (10° to 43° C.). Line 81 then carries the mixed refrigerant fluid to heat exchanger 82, where it is cooled to between about 60° and 0° F. (8° to −18° C.). Heat exchanger 82 can utilize any of a number of suitable refrigerants well known to those skilled in the art. Such refrigerants include propane, propylene, ammonia, carbon dioxide and freon.

After exiting heat exchanger 82, the mixed refrigerant fluid passes through line 83 and into heat exchanger 84, where the first of three stages of cooling by the $C_2$ hydrocarbon refrigerant contained in the single refrigerant system takes place. The first stage cools the mixed refrigerant fluid to a temperature of around −60° F. (−51° C.). The mixed refrigerant fluid then passes through line 85 and into heat exchanger 86 for the second stage of cooling, where the temperature of the mixed refrigerant fluid is reduced to about −85° F. (−65° C.). The mixed refrigerant fluid then passes through line 87 to heat exchanger 88 where the third and final stage of cooling takes place. Having gone through the three stages of cooling, the mixed refrigerant fluid will be at a temperature of about −120° F. (−84° C.). The mixed refrigerant fluid then flows from heat exchanger 88 through line 89 to separator 92.

Line 93 carries the mixed refrigerant vapor from the top of separator 92 to first cryogenic heat exchanger 39. The mixed refrigerant vapor is at a temperature of around −120° F. (−84° C.) as it enters the first cryogenic heat exchanger and is cooled and condensed therein by the mixed refrigerant fluid from line 100, which will be described below. The mixed refrigerant vapor then flows to second cryogenic heat exchanger 40 through line 94. In the second cryogenic heat exchanger, the mixed refrigerant vapor is further condensed to liquid and subcooled by heat exchange with the mixed refrigerant fluid from line 96. The subcooled mixed refrigerant liquid exits the second cryogenic heat exchanger through line 95 and is flashed across J-T valve 43, which vaporizes some of the mixed refrigerant liquid and reduces the temperature of the mixed refrigerant to between about −250° and −269° F. (−157° to −167° C.). The cold mixed refrigerant fluid then reenters second cryogenic heat exchanger 40 through line 96. The heat exchange between the natural gas stream and the cold mixed refrigerant fluid in the second cryogenic heat exchanger liquefies the natural gas with slight or deep subcooling.

The mixed refrigerant liquid in the bottom of separator 92 flows to first cryogenic heat exchanger 39 through line 97 and is cooled by heat exchange with the cold mixed refrigerant fluid from line 100. The mixed refrigerant liquid exits the first cryogenic heat exchanger in a subcooled state through line 98 and is flashed across J-T valve 42. This vaporizes some of the mixed refrigerant liquid and reduces the temperature of the mixed refrigerant to between about −185° and −220° F. (−121° to −140° C.). The mixed refrigerant fluid then passes through line 99 and into line 100, where it is combined with the cold mixed refrigerant fluid returning from second cryogenic heat exchanger 40. The mixed refrigerant fluid in line 100 then reenters the cold end of first cryogenic heat exchanger 39 and provides the cooling duty therein. In the first cryogenic heat exchanger, the mixed refrigerant in line 100 cools the natural gas in line 38, the mixed refrigerant vapor in line 93 and the mixed refrigerant liquid in line 97. The mixed refrigerant fluid then exits cryogenic heat exchange system 65 through line 70 and goes to heat exchanger 37 to complete the cycle of the mixed refrigerant system. The description of the first preferred embodiment now turns to the single refrigerant system, which is used to precool the natural gas and also to cool the mixed refrigerant.

The single refrigerant system contains a $C_2$ hydrocarbon refrigerant, either ethane or ethylene. The choice depends primarily on the relative price and availability of ethane and ethylene at the LNG plant site, although ethane is preferred from a thermodynamic standpoint. The temperatures and pressures in the following description are based on the use of ethane as the $C_2$ hydrocarbon refrigerant, which will be referred to as the single refrigerant.

Following compression in compressor 110, the single refrigerant vapor is at a pressure of around 166 psia (1144 kPa). The single refrigerant vapor passes through line 111 to desuperheater 112, where its temperature is reduced, without being condensed. The desuperheater can use water for the initial cooling and can use various refrigerants for additional cooling, as is well known. The single refrigerant vapor then flows via line 113 to condenser 114, which can utilize any of a number of suitable refrigerants such as propane, propylene, ammonia, carbon dioxide and freon. The condenser cools the single refrigerant to a temperature of around −20° F. (−29° C.), thereby condensing substantially all of the single refrigerant vapor into liquid. The single refrigerant liquid then passes through line 115 and into accumulator 116.

The single refrigerant liquid exits the accumulator through line 117 and goes to heat exchanger 118, where it is subcooled. Heat exchanger 118 can use propane, propylene, ammonia, carbon dioxide, freon or any other suitable refrigerant to subcool the single refrigerant liquid. The single refrigerant liquid then exits heat exchanger 118 through line 119 and is split into two streams. One stream goes through line 120 and the other stream goes through line 121. The stream passing through line 120 is flashed across J-T valve 122 to produce a stream having a pressure of about 70 psia (483 kPa) and a temperature of about −65° F. (−54° C.). The resulting two-phase single refrigerant stream then enters separator 124 via line 123.

The single refrigerant liquid stream which was split off into line 121 is flashed across J-T valve 125 to produce a two-phase stream with a pressure of about 70 psia (483 kPa) and a temperature of about −65° F. (−54° C.). This two-phase single refrigerant stream then goes via line 126 to heat exchanger 84 to provide the first of three stages of cooling for the mixed refrigerant, as described above. As a result of the heat exchange with the warmer mixed refrigerant, most of the liquid fraction of the two-phase single refrigerant stream is vaporized. The single refrigerant vapor passes from heat exchanger 84 through line 127 and into separator 124, where it is recombined with the other single refrigerant stream from line 123.

The vapor fraction from separator 124 passes through lines 128 and 129 to compressor 110 for recompression. This relatively cold vapor provides some interstage cooling for the single refrigerant exiting compressor 130 through line 129. The single refrigerant liquid in the bottom of separator 124 exits through line 131 and is split into two streams, which flow in lines 132 and 133 respectively. The single refrigerant liquid in line 132 is flashed across J-T valve 134. This vaporizes a portion of the liquid and reduces the pressure and temperature of the stream to about 40 psia (276 kPa) and −90° F. (−68° C.). The resulting two-phase stream then goes into separator 136 via line 135.

The other stream of single refrigerant which was split off into line 133 is flashed across J-T valve 137 prior to providing the second stage of cooling for the mixed refrigerant. The flashing drops the pressure and temperature of the stream to about 40 psia (276 kPa) and −90° F. (−68° C.). This stream then goes through line 138 and into heat exchanger 86, where the second stage of mixed refrigerant cooling takes place. The single refrigerant stream exiting from heat exchanger 86 is substantially all vapor and passes through line 139 and into separator 136 where it rejoins the single refrigerant stream from line 135. The single refrigerant vapor from separator 136 is sent via lines 140 and 141 to compressor 130, and provides some interstage cooling of the single refrigerant coming from compressor 142.

The single refrigerant liquid in the bottom of separator 136 exits through line 143 and is split into two streams, which flow in lines 144 and 145 respectively. The single refrigerant liquid in line 144 is used to provide the third and final stage of mixed refrigerant cooling and the liquid in line 145 is used to provide the condenser duty for the demethanizer overhead. The single refrigerant liquid in line 144 is flashed by J-T valve 146 down to a pressure of about 15.5 psia (107 kPa). The resulting two-phase single refrigerant stream is thereby cooled to about −125° F. (−87° C.) and is sent through line 147 to heat exchanger 88 to cool the mixed refrigerant. The consequent warming of the single refrigerant stream vaporizes substantially all of the single refrigerant liquid. The single refrigerant vapor leaves heat exchanger 88 via line 148 and goes through line 149 and into scrubber 150.

Before being used to precool the natural gas in reflux condenser 28, the single refrigerant liquid in line 145 is flashed across J-T valve 151. This causes the pressure of the single refrigerant to drop to about 15.5 psia (107 kPa) and lowers its temperature to around −125° F. (−87° C.). Line 152 carries this single refrigerant to reflux condenser 28, where the precooling of the natural gas takes place. The heat exchange with the natural gas warms the single refrigerant, and typically vaporizes all of the remaining liquid portion. The single refrigerant vapor exits reflux condenser 28 and flows through line 153 to line 149, where it is combined with the single refrigerant vapor from heat exchanger 88. The combined single refrigerant vapor stream then enters scrubber 150, where any liquid single refrigerant is removed to protect compressor 142. Accumulated liquid single refrigerant from scrubber 150 is removed through line 154 by pump 155 and sent to storage (not shown) for eventual reintroduction into the single refrigerant system as makeup refrigerant.

The dry single refrigerant vapors from scrubber 150 go through line 156 to compressor 142 for the first of three stages of compression. Compressor 142 increases the pressure of the single refrigerant vapor to about 37 psia (255 kPa). The compressed vapor then passes through line 141 and is combined with the single refrigerant vapor from line 140 before entering compressor 130 for the second stage of compression. The second compression stage increases the pressure of the single refrigerant vapor to about 80 psia (552 kPa). The single refrigerant vapor exits compressor 130 via line 129 and is combined with the single refrigerant vapor from line 128. This combined single refrigerant vapor stream then enters compressor 110 for the third and final stage of compression, where the pressure of the single refrigerant is increased to about 170 psia (1172 kPa). This completes the cycle of the single refrigerant system and concludes the description of the first preferred embodiment. The description now turns to a second preferred embodiment.

Figure 2:
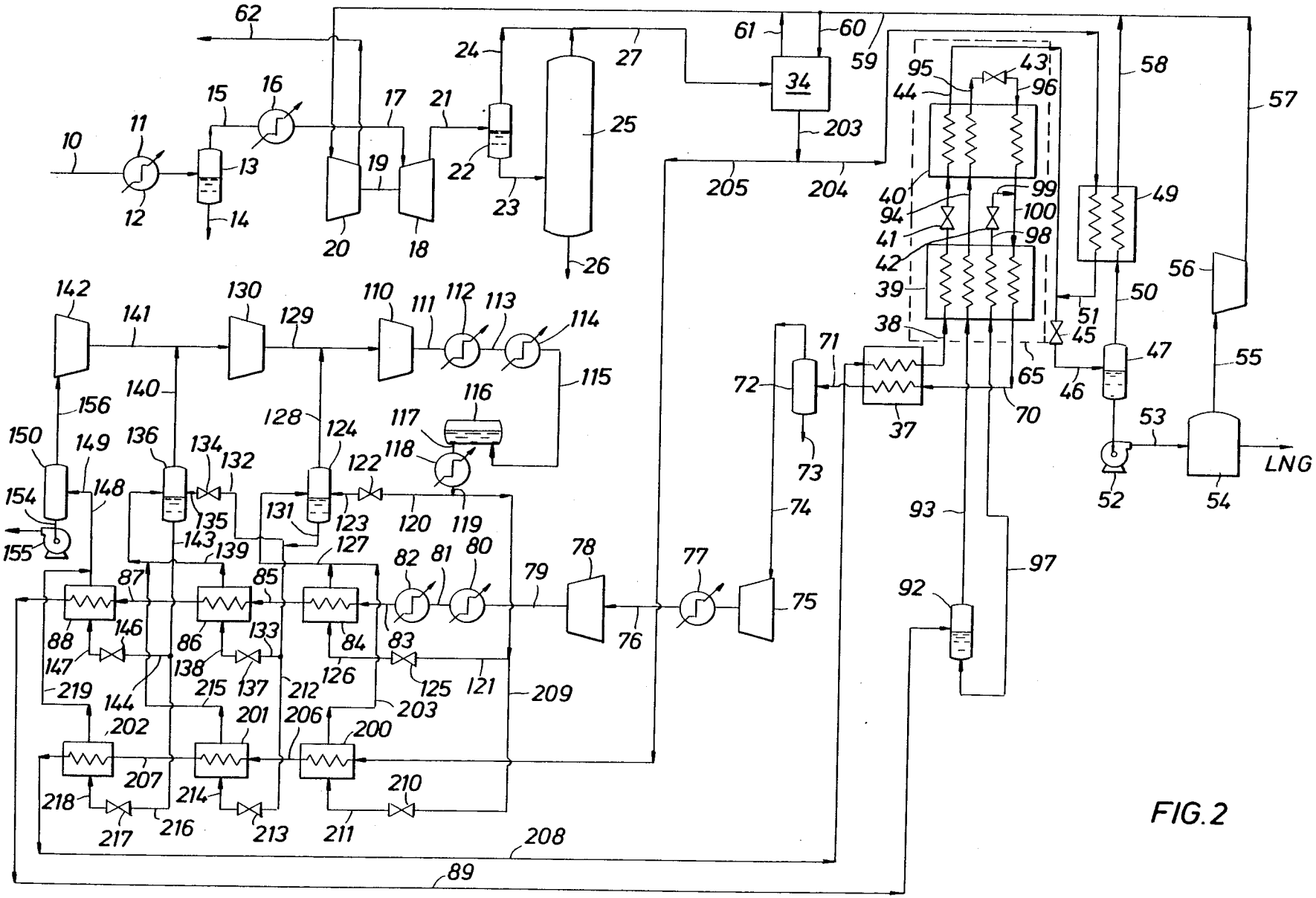
FIG. 2 is a schematic flow diagram of a liquefaction process illustrating a second preferred embodiment of the present invention.

Referring to FIG. 2, a second preferred embodiment for practicing the process of the present invention is illustrated. It shows a schematic representation of an LNG plant which, like the first embodiment, has a single refrigerant system and a mixed refrigerant system. The second embodiment is similar in many respects to the first embodiment, and like numbers designate like components. Therefore, the description of the second embodiment will focus on those aspects which differ from the first embodiment.

The second embodiment uses the same refrigerants in the single refrigerant system and in the mixed refrigerant system as used in the first embodiment. The single refrigerant is a $C_2$ hydrocarbon, either ethane or ethylene, and the mixed refrigerant consists essentially of nitrogen, methane and a $C_2$ hydrocarbon, either ethane or ethylene. As with the first embodiment, the second embodiment also employs turboexpander 18 to reduce the pressure of the high pressure feed stream of natural gas, thereby cooling it, and also subjects the natural gas to liquefaction cooling steps before substantial warming occurs. However, unlike the first embodiment, the second embodiment precools the natural gas by three stages of heat exchange with the single refrigerant before it enters the cryogenic heat exchange system, rather than by a single stage.

Three stages of precooling are provided in the second embodiment because the natural gas exiting the top of demethanizer 25 through line 27 is not as cold as in the first embodiment, where the temperature was between about −60° and −125° F. (−51° to −87° C.). In the second embodiment, the overhead from the is between about −50° and demethanizer −55° F. (−46° to −48° C.). There are two primary reasons why the overhead from the demethanizer is in this higher temperature range. The first reason is that the pressure of the feed stream of natural gas is lower than the 1000 to 2000 psia (6895 to 13790 kPa) range which existed for the first embodiment. Where the feed stream is instead available at a pressure between about 600 and 1000 psia (4137 and 6895 kPa), the expansion which takes place in turboexpander 18 to between about 450 and 650 psia (3103 to 4482 kPa) will not cool the natural gas to the −60° and −125° F. (−51° to −87° C.) range as in the first embodiment. Instead, the natural gas will be cooled only to between about −40° and −60° F. (−40° to −51° C.). Since the natural gas enters the demethanizer at a higher temperature in the second embodiment, it exits at a higher temperature.

The second reason why the demethanizer overhead is at a higher temperature is that reflux condenser 28 and separator 30 of the first embodiment have been omitted (see FIG. 1). Because the reflux is omitted, the overhead stream from the demethanizer is warmer. The absence of reflux condenser 28 and separator 30 may result from the use of existing plant equipment which lacks these components.

Where the overhead from the demethanizer is available in the temperature range of between about −40° and 60° F. (−40° to −51° C.), the second embodiment illustrated in FIG. 2 is preferred over the first. Reflux condenser 28 of the first embodiment is replaced in the second embodiment by three heat exchangers 200, 201 and 202, which provide the three stages of precooling of the natural gas by the single refrigerant. Referring to FIG. 2, the natural gas exiting demethanizer 25 flows though line 27 directly to dehydration system 34. This is because no reflux is provided for the demethanizer in the second embodiment. Also, because no reflux is provided, the natural gas vapor exiting separator 22 goes via line 24 to line 27 and joins with the demethanizer overhead, rather than entering the demethanizer as in the first embodiment.

After dehydration, the natural gas exits dehydration system 34 through line 203 and is split into two streams, a main stream and a side stream. The side stream goes through line 204 and is liquefied in heat exchanger 49 as in the first embodiment. The main stream is carried by line 205 to the three stages of precooling provided by the single refrigerant in heat exchangers 200, 201 and 202.

The first stage of precooling by the single refrigerant takes place in heat exchanger 200. There, the natural gas is desirably cooled to about −60° F. (−51° C.). The natural gas then flows through line 206 to heat exchanger 201 for the second stage of precooling, which reduces the temperature of the natural gas to about −85° F. (−65° C.). The natural gas then flows through line 207 to the third and final stage of precooling by the single refrigerant. This takes place in heat exchanger 202, where the natural gas is cooled to about −115° F.

(−82° C.). The precooled natural gas then flows through line 208 to heat exchanger 37 for cooling by the mixed refrigerant and then on to cryogenic heat exchange system 65 for liquefaction in the same manner as in the first embodiment. The entire mixed refrigerant system of the second embodiment is similar to that of the first embodiment, although, obviously, the temperatures therein may be somewhat different due to the varied heat loads placed on the single refrigerant system by heat exchangers 200, 201 and 202.

The difference between the single refrigerant systems of the first and second embodiments are associated with the introduction of the three precooling heat exchangers 200, 201 and 202 in the second embodiment. The single refrigerant liquid from heat exchanger 118 is split into three streams, rather than two streams as in the first embodiment. Like the first embodiment, one of the streams goes though line 120 to separator 124 and another goes via line 121 to heat exchanger 84 to cool the mixed refrigerant. Unlike the first embodiment, the second embodiment has a third stream of single refrigerant liquid which flows through line 209 and is flashed across J-T valve 210. This vaporizes some of the single refrigerant liquid and reduces its pressure to about 70 psia (483 kPa) and its temperature to about −65° F. (−54° C.). This single refrigerant fluid then goes through line 211 and into heat exchanger 200 for the first stage of natural gas precooling. The heat exchange with the natural gas vaporizes substantially all of the single refrigerant, and the resulting vapor travels through line 203 to be joined in line 127 with the single refrigerant vapor from heat exchanger 84. This vapor stream is then handled in the same way as in the first embodiment, going to separator 124.

In the second embodiment, the single refrigerant liquid from the bottom of separator 124 is split into three streams rather than two, in order to provide the extra stream needed for the second stage of natural gas precooling. This extra stream is carried by line 212 to J-T valve 213, where it is flashed to a pressure of about 40 psia (276 kPa) and a temperature of about −90° F. (−68° C.). The single refrigerant then passes through line 214 and into heat exchanger 201, where it provides the second stage of natural gas precooling. The single refrigerant vapor exiting heat exchanger 201 flows through line 215 and into line 139 where it combines with the single refrigerant vapor from heat exchanger 86. The combined vapors are then handled in the same manner as in the first embodiment, being transmitted to separator 136.

As in the first embodiment, the single refrigerant liquid from the bottom of separator 136 goes through line 143 and is split into two streams, one of which goes through J-T valve 146 and into heat exchanger 88 to cool the mixed refrigerant. However, in the second embodiment, the other stream passes through line 216 to J-T valve 127, where it is flashed down to a pressure of about 15.5 psia (107 kPa) and a temperature of about −125° F. (−87° C.). This stream of single refrigerant travels through line 218 and into heat exchanger 202 to provide the third stage of natural gas precooling. The heat exchange with the natural gas typically vaporizes the remaining liquid portions of the single refrigerant. This vapor goes through line 219 to line 148 where it combines with the single refrigerant vapors from heat exchanger 88. The combined vapors flow into scrubber 150, where they are scrubbed of entrained liquids, and then go to three stages of compression in compressors 142, 130 and 110, just as in the first embodiment.

Those skilled in the art will recognize that it may not always be necessary to put the natural gas through all three stages of precooling provided by the single refrigerant system of the second embodiment. Where the natural gas from the demethanizer is cold enough, only two stages or perhaps a single stage of precooling may be desired. This is readily accomplished by having the natural gas stream merely bypass the first and second stages of precooling.

The temperatures and pressures given in the description above are examples and are not intended to limit the present invention. Inasmuch as the present invention is subject to many variations, modifications and changes in detail, it is intended that all subject matter discussed above or shown in the accompanying drawings be interpreted as illustrative and not in a limiting sense. Such modifications and variations are included within the scope of the present invention as defined by the following claims.

What is claimed is:

1. A process for liquefying natural gas comprising the steps of:

(a) supplying said natural gas at a pressure above about 600 psia (4137 kPa);

(b) expanding said natural gas to reduce its temperature below about −40° F. (−40° C.);

(c) precooling said natural gas by heat exchange with a $C_2$ hydrocarbon refrigerant contained in a single refrigerant system;

(d) cooling a mixed refrigerant contained in a mixed refrigerant system by heat exchange with said $C_2$ hydrocarbon refrigerant, wherein said mixed refrigerant consists essentially of nitrogen, methane and a $C_2$ hydrocarbon; and (e) liquefying said precooled natural gas by heat exchange with said mixed refrigerant.

2. The process of claim 1 wherein said natural gas is passed through a demethanizer after step (b) and before step (c).

3. The process of claim 1 wherein said natural gas is precooled in step (c) before substantial warming occurs.

4. The process of claim 1 wherein said natural gas is expanded in step (b) through a turboexpander.

5. The process of claim 1 wherein said natural gas is precooled in step (c) by at least two stages of heat exchange with said $C_2$ hydrocarbon refrigerant.

6. The process of claim 1 wherein said mixed refrigerant is cooled in step (d) by at least two stages of heat exchange with said $C_2$ hydrocarbon refrigerant.

7. The process of claim 1 wherein said precooled natural gas is liquefied in step (e) by heat exchange with said mixed refrigerant in at least two cryogenic heat exchangers.

8. The process of claim 7 wherein at least one of said cryogenic heat exchangers is a coil-wound heat exchanger.

9. The process of claim 7 wherein at least one of said cryogenic heat exchangers is a plate-fin heat exchanger.

10. A process for liquefying natural gas comprising the steps of:

(a) supplying said natural gas at a pressure above about 1000 psia (6895 kPa);

(b) expanding said natural gas in a turboexpander to reduce its temperature below about −60° F. (−51° C.);

(c) passing said natural gas through a demethanizer to remove the heavier components therefrom;

(d) precooling said natural gas, before substantial warming occurs, by at least one stage of heat exchange with a $C_2$ hydrocarbon refrigerant contained in a single refrigerant system;

(e) cooling a mixed refrigerant contained in a mixed refrigerant system by at least three stages of heat exchange with said $C_2$ hydrocarbon refrigerant, wherein said mixed refrigerant consists essentially of nitrogen, methane and a $C_2$ hydrocarbon; and (f) liquefying said precooled natural gas by heat exchange with said mixed refrigerant in at least one cryogenic heat exchanger.

11. A process for liquefying natural gas comprising the steps of:

(a) supplying said natural gas at a pressure above about 600 psia (4137 kPa);

(b) expanding said natural gas in a turboexpander to reduce its temperature below about −40° F. (−40° C.);

(c) passing said natural gas through a demethanizer to remove the heavier components therefrom;

(d) precooling said natural gas, before substantial warming occurs, by at least three stages of heat exchange with a $C_2$ hydrocarbon refrigerant contained in a single refrigerant system;

(e) cooling a mixed refrigerant contained in a mixed refrigerant system by at least three stages of heat exchange with said $C_2$ hydrocarbon refrigerant, wherein said mixed refrigerant consists essentially of nitrogen, methane and a $C_2$ hydrocarbon; and (f) liquefying said precooled natural gas by heat exchange with said mixed refrigerant in at least one cryogenic heat exchanger.

* * * * *

UNITED STATES PATENT AND TRADEMARK OFFICE

CERTIFICATE OF CORRECTION

PATENT NO. : 4,548,629

DATED : October 22, 1985

INVENTOR(S) : Chen-hwa Chiu

It is certified that error appears in the above-identified patent and that said Letters Patent is hereby corrected as shown below:

In column 10, line 9 of the Patent, insert --demethanizer-- after "the" and before "is"; and In column 10, line 10 of the Patent, delete "demethanizer".

Signed and Sealed this

Seventh Day of October, 1986

[SEAL]

*Attest:*

DONALD J. QUIGG

*Attesting Officer*

*Commissioner of Patents and Trademarks*